United States Patent [19]

McNamara

[11] Patent Number: 5,014,429

[45] Date of Patent: May 14, 1991

[54] MECHANISM FOR DETACHING BLADE SEGMENTS FROM A SEGMENTED KNIFE BLADE

[76] Inventor: William J. McNamara, R.R. 3, Box 426A Pine Bank Rd., Flemington, N.J. 08822

[21] Appl. No.: 483,925

[22] Filed: Feb. 23, 1990

[51] Int. Cl.[5] ..... B26B 3/08; B26B 1/00; B26B 1/08

[52] U.S. Cl. ..... 30/162; 30/320; 30/335

[58] Field of Search ..... 30/162, 255, 290, 294, 30/320, 335, 339; 7/163, 164

[56] References Cited

U.S. PATENT DOCUMENTS

| | | | |
|---|---|---|---|
| 4,063,356 | 12/1977 | Hepworth | 30/162 |
| 4,240,202 | 12/1980 | Gilbert | 30/320 |
| 4,322,885 | 4/1982 | Osada | 30/320 |

*Primary Examiner*—Douglas D. Watts
*Assistant Examiner*—Paul M. Heyrana, Sr.
*Attorney, Agent, or Firm*—Lerner, David, Littenberg, Krumholz & Mentlik

[57] ABSTRACT

A utility knife includes a mechanism for detaching the individual blade segments along segmentation lines from a segmented knife blade. The detachment mechanism includes a plunger located at the forward end of the utility knife. An adjustment mechanism advances the knife blade for alignment between the plunger and a retention chamber. Actuation of the plunger exerts a transverse force on the blade segment, detaching same from the remainder of the blade. The retention chamber prevents the detached blade segment from flying from the utility knife where it could cause injury or damage. Optionally, the utility knife may include a spare blade storage compartment and/or a guidance mechanism to facilitate the cutting of straight or curved lines in particular situations.

27 Claims, 4 Drawing Sheets

19
16
26
24
24a
19
14
18a
18
28
20
54
20c
20b
20a
21
30
32
47
46
18b
29
36
40
8
34
42
38
44

MECHANISM FOR DETACHING BLADE SEGMENTS FROM A SEGMENTED KNIFE BLADE

FIELD OF THE INVENTION

The present invention relates to a device for, and methods of, detaching one or more blade segments from a segmented utility knife blade.

BACKGROUND OF THE INVENTION

Utility knives for a variety of purposes have been around for many years. These knives typically include razor-sharp blades which permit clean, accurate cuts to be made in a variety of materials as desired. The typical utility knife consists of a handle which houses a replaceable blade. Thus, as the blade becomes dull from repeated use it can be replaced with a fresh blade without having to discard the entire knife.

Over the years it became apparent that generally only the tip of the blade was becoming worn, while the remainder of the cutting edge remained fairly sharp. Thus, blades were being discarded which, for the most part, still maintained an adequate cutting edge for substantially their entire length.

With this recognition came the advent of segmented knife blades. In these devices, the knife blade is divided into a plurality of segments by scored lines which traverse the blade at regular intervals along its length. By detaching a blade segment from the remainder of blade along one of these weakened segmentation lines, the worn tip of the blade may be discarded while simultaneously providing a new, sharp tip for the blade. Thus, by detaching individual blade segments from the blade the entire cutting edge of the blade is utilized in a more uniform fashion and the life of the blade is extended.

With currently available utility knives having segmented blades, it is necessary to extend those blade segments which one desires to detach from the remainder of the blade outside of the blade handle or housing. One may then grasp the extended blade segments and break them along a segmentation line from the remainder of the blade. Since the force required to break the blade segments from the remainder of the blade is rather severe, this procedure is not typically done by hand as it could easily result in injury. Therefore, a pair of pliers or similar instrument may be used to grasp the extended blade segments for breaking from the remainder of the blade. While these instruments may facilitate the breaking of the blade segments, they are nonetheless cumbersome to use and do not provide adequate safeguards from injury.

In many situations, pliers or other instruments are not available to detach the blade segments. Therefore, in order to facilitate this procedure, utility knives were developed in which the handle or housing includes a detachable device having a slot which may be assembled over the blade segments to provide grasping means for detaching the blade segments.

Even when these devices for grasping the blade segments are utilized, however, there is still a very real potential for injury. Thus, should the device not grasp the blade segments securely, the blade segments may be sent flying and result in injury as they are detached from the remainder of the blade. Furthermore, the force required to break the blade segments from the remainder of the blade may result in cuts to one's hand from either the detached blade segments or the portion of the blade which remains. Additionally, detachment of the blade segments may result in the formation of metal splinters which could easily cause injury. Still further, detaching the blade segments carelessly or in an improper manner may result in personal injury or damage to the handle or housing.

Thus, the need exists for a device which will enable the blade segments to be detached from a segmentable knife blade without exposure to the aforementioned hazards. There is also a need for such a device which can be readily incorporated into presently available utility knife designs.

SUMMARY OF THE INVENTION

In accordance with one aspect of the present invention, these needs have now been addressed by the invention of a mechanism for detaching blade segments along segmentation lines from a segmented knife blade contained within a housing. The mechanism consists of means in the housing for supporting one longitudinal face of the knife blade, the support means having an edge disposed for substantial alignment with the segmentation lines of the knife blade. The mechanism further includes means for adjusting the knife blade so that at least one blade segment extends adjacent an unsupported region beyond the edge of the support means. Plunger means slidably disposed in the housing opposite the unsupported region impart a lateral force upon the at least one extended blade segment to detach the at least one extended blade segment from the knife blade.

In one embodiment of the invention, the mechanism includes alignment means for positioning the at least one extended blade segment between the unsupported region and the plunger means. Preferably, the alignment means consists of an aperture in the housing for visibly positioning the at least one extended blade segment.

In another embodiment of the invention, the mechanism further includes means in the housing for retaining the at least one blade segment as the at least one blade segment is detached from the knife blade. The retaining means may consist of a chamber disposed opposite the plunger means so that the at least one blade segment extends between the plunger means and the chamber means.

In one variant of this last embodiment, the mechanism further includes means for removing the at least one blade segment from the chamber after the at least one blade segment is detached from the knife blade. Preferably, the removal means consists of an outlet connecting the retaining means to the exterior of the housing.

In accordance with another aspect of the present invention, a utility knife is disclosed having a housing and an elongated knife blade disposed in the housing, the knife blade including a plurality of blade segments joined along segmentation lines. The utility knife also has means for detaching the plurality of blade segments interior of the housing. The utility knife may further include means in the housing for supporting one longitudinal face of the knife blade, the support means having an edge disposed for substantial alignment with the segmentation lines of the knife blade, and means for adjusting the knife blade so that at least one blade segment extends adjacent an unsupported region beyond the edge of the support means.

Preferably, the means for detaching the plurality of blade segments consists of plunger means slidably disposed in the housing opposite the unsupported region to impart a lateral force upon the at least one extended blade segment to detach the at least one extended blade segment from the knife blade.

In accordance with another embodiment of this aspect of the present invention, the utility knife further includes alignment means for positioning the at least one extended blade segment between the unsupported region and the plunger means. Preferably, the alignment means consists of an aperture in the housing for visibly positioning the at least one extended blade segment.

In yet another embodiment, the utility knife further includes means in the housing for retaining the at least one blade segment as the at least one blade segment is detached from the knife blade. Desirably, the retaining means consists of chamber means disposed opposite the plunger means, the at least one blade segment extending between the plunger means and the chamber means.

In still another embodiment, the utility knife includes means for removing the at least one blade segment from the housing after the at least one blade segment is detached from the knife blade. In preferred embodiments, the removal means consists of an outlet connecting the retaining means to the exterior of the housing.

Optionally, the utility knife may include roller means positioned at a front end of the housing for guiding the knife blade along a cutting path. The roller means may consist of two rollers rotatable about the same axis, the knife blade being extendable between the rollers.

A highly preferred utility knife in accordance with the present invention consists of an elongated handle having a front end, a back end, a top edge and a bottom edge, the handle including a first sidewall secured to a second sidewall, at least one of the first and second sidewalls having a lengthwise internal passageway and at least one of the first and second sidewalls having a lengthwise external opening, the opening being at least partially coextensive with the passageway. An elongated knife blade having a plurality of blade segments joined along segmentation lines is slidably mounted between the first and second sidewalls and extendable from the front of the handle. The utility knife is provided with means in the handle for supporting one longitudinal face of the knife blade, the support means having an edge disposed for substantial alignment with the segmentation lines of the knife blade. Means are further provided for adjusting the knife blade so that at least one blade segment extends adjacent an unsupported region beyond the edge of the support means. Plunger means slidably disposed in the handle opposite the unsupported region impart a lateral force upon the at least one extended blade segment to detach the at least one extended blade segment from the knife blade.

Desirably, the last described utility knife includes a protruding member slidably mountable within the passageway and removably fixed to the knife blade, biasing means positioned against the knife blade for holding the knife blade against the protruding member and releasing means for moving the knife blade laterally against the biasing means, away from the protruding member, to release the knife blade from the protruding member. Desirably, the protruding member is affixed to the knife blade adjustment means.

Optionally, the highly preferred embodiment of the utility knife may include a blade storage compartment for the storage of spare knife blades.

Yet another aspect of the present invention provides a method of detaching blade segments along segmentation lines from a segmented knife blade. One longitudinal face of the knife blade is supported against a support member in a housing, the support member having an edge disposed for substantial alignment with the segmentation lines of the knife blade. The knife blade is then adjusted so that at least one blade segment extends between an unsupported region beyond the edge of the support member and a transversely mounted plunger. Actuating the plunger imparts a lateral force upon the at least one extended blade segment to detach the at least one extended blade segment from the knife blade. Desirably, the at least one blade segment is retained in the housing as the at least one blade segment is detached from the knife blade. Following detachment from the knife blade, the at least one blade segment may be removed from the housing.

Preferred methods of the present invention provide safe procedures for detaching blade segments from a segmented knife blade. Not only is the risk of injury to the user reduced by these preferred methods, but they are readily performed.

Moreover, preferred detachment mechanisms according to the present invention accomplish the aforementioned methods in a reliable manner. The highly preferred mechanisms have a relatively simple construction which may readily be incorporated into utility knife designs which are currently available without the need to significantly alter the design of their housing or other components. When incorporated in a utility knife, the detachment mechanism of the present invention will be easy to operate, and will do so without defect over long periods of time.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION

Figure 1:
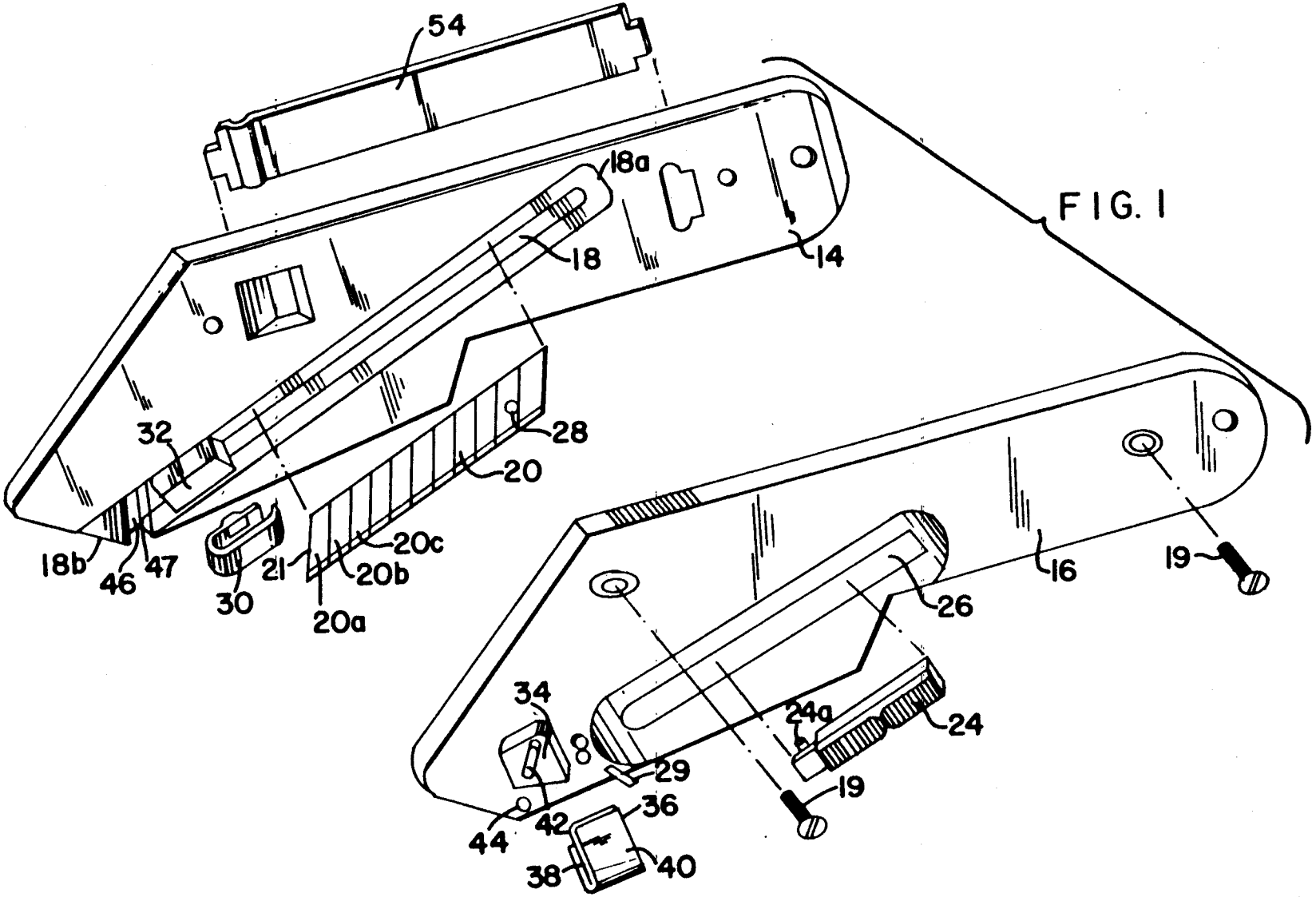
FIG. 1 is an exploded, perspective view showing the assembly of the blade detachment mechanism of the present invention in a first utility knife.
Figure 7:
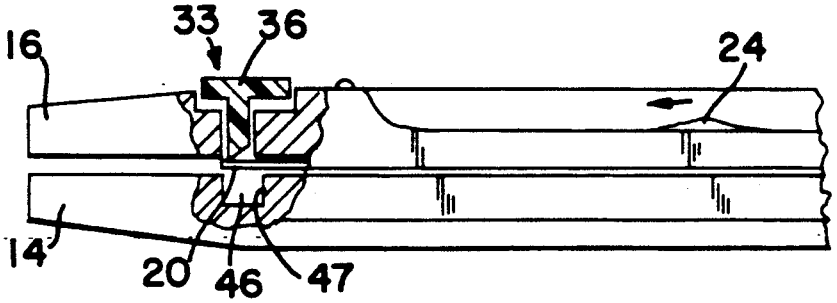
FIG. 7 is a bottom, plan, partial view of the utility knife shown in FIG. 1, partially broken away to reveal the blade advanced to a position for detachment and the plunger poised for activation.

The mechanism of the present invention for detaching blade segments from a segmented knife blade may be incorporated into a variety of utility knives, such as those illustrated in FIGS. 1 and 7. Utility knives of the types shown are known in the art and are described in detail in U.S. patent application Ser. No. 204,104, the specification of which is incorporated by reference herein.

Figure 2:
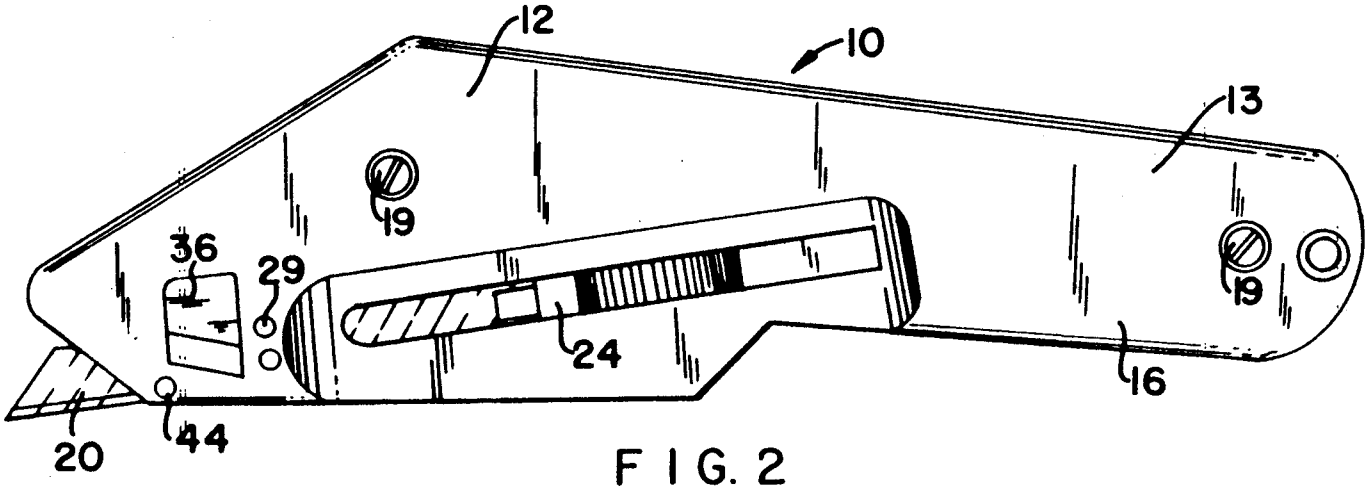
FIG. 2 is a side, elevational view of the utility knife of FIG. 1.
Figure 3:
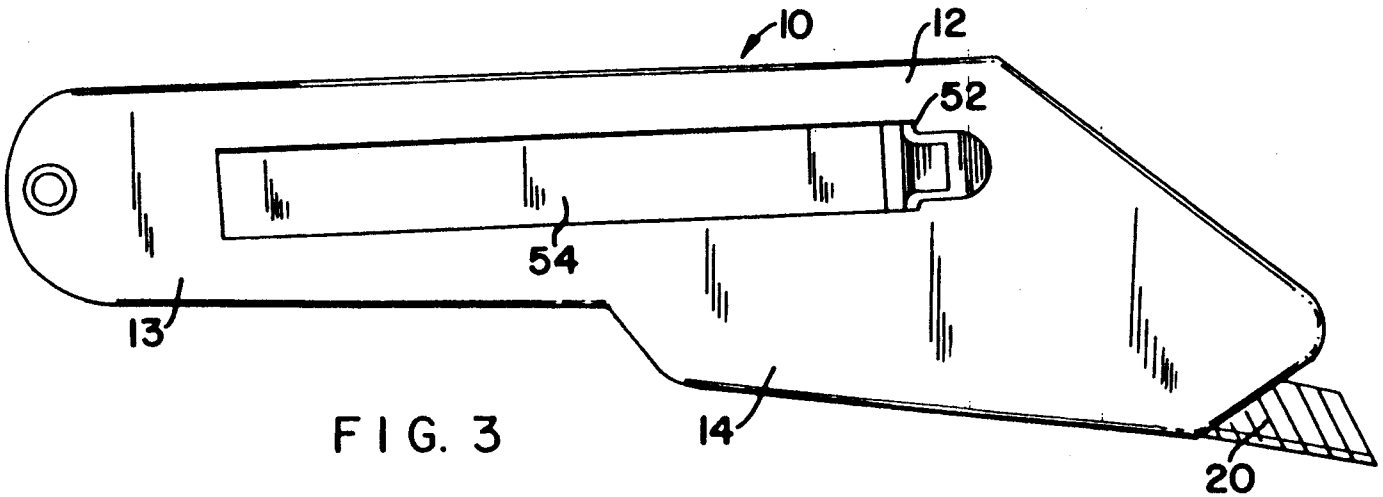
FIG. 3 is an opposite side, elevational view of the utility knife of FIG. 1.

Referring to FIGS. 1-3, the utility knife 10 of the present invention includes a housing indicated generally at 12. Housing 12 includes spaced sidewall portions 14 and 16 which may be made of any suitably rigid and durable material. Preferably, housing 12 is sized and shaped to incorporate handle portion 13 therein. Defined between sidewall portions 14 and 16 is a channel 18 which houses and guides blade 20. On one end channel 18 terminates within handle 12 to form a closed end 18*a*, while on the opposite end channel 18 exits from the handle 12 to form an exit slot 18*b* from which blade 20 may protrude from handle 12. Sidewall portions 14 and 16 may be assembled together by any suitable means which permits their easy separation for the replacement of blade 20. Although the figures show sidewall portions held together by screws 19, other assembly means such as press fit, snap fit, clasps and the like may be utilized.

Blade 20 is a segmented blade of the type generally known in the art. Thus, blade 20 consists of individual blade segments 20*a*, 20*b*, 20*c*, etc. which are separated by weakened areas defined by segmentation lines 22.

So that blade 20 may be advanced or retracted within or beyond handle 12, utility knife 10 is provided with an adjustment mechanism 24 which is disposed for back and forth sliding movement within slot 26 formed in sidewall portion 16. Adjustment mechanism 24 includes boss 24*a* which engages aperture 28 in blade 20 so that blade 20 advances or retracts in handle 12 simultaneously with the corresponding movement of adjustment member 24.

In order to stabilize blade 20, sidewall portion 14 includes spring member 30 in a recess 32 formed near exit slot 18*b* of channel 18. Spring member 30 provides a force to bias blade 20 against sidewall portion 16 and thereby prevent the lateral displacement or rattling of blade 20 within channel 18. At the same time, spring member 30 biases blade 20 against adjustment member 24 to maintain the engagement of boss 24*a* within aperture 28.

The removal of blade 20 from housing 12 is facilitated by the provision of release button 29. By depressing release button 29, spring member 30 is compressed so that it no longer biases blade 20 against adjustment member 24. Consequently, boss 24*a* becomes disengaged from aperture 28, and blade 20 may be easily removed from housing 12 simply by grasping its exposed tip and sliding it outward from exit slot 18*b*.

Figure 4:
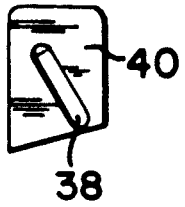
FIG. 4 is a rear view of the plunger component of the blade detachment mechanism of the present invention.
Figure 5:
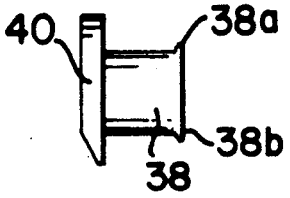
FIG. 5 is a side elevational view of the plunger component shown in FIG. 4.

At the forward end of utility knife 10 near blade exit slot 18*b*, utility knife 10 includes a mechanism for detaching the individual blade segments from blade 20. The actuation portion of detachment mechanism 33 includes plunger 36 which is slidably engaged in a recess 34 in sidewall portion 16. As shown in FIGS. 4 and 5, plunger 36 consists of an elongated boss 38 which protrudes from the rear of button member 40. Elongated boss 38 is disposed for slidable displacement within slot 42 which extends through sidewall portion 16 at the bottom of recess 34. Flanges 38*a* and 38*b*, disposed on opposed longitudinal edges of the free end of elongated boss 38, as clearly shown in FIG. 5, prevent the removal of plunger 36 from sidewall portion 16. An alignment aperture 44, the use of which is described more fully below, extends through sidewall portion 16 at a point below and adjacent to plunger 36.

At a location opposite slot 42 and alignment aperture 44, sidewall portion 14 includes an elongated chamber 46 which runs in a direction generally transverse to channel 18. Preferably, elongated chamber 46 runs in a direction which is substantially parallel to the segmentation lines 22 when blade 20 is in assembled position within channel 18. Chamber 46 has a sufficient length and width to comfortably receive at least one of the individual segments of blade 20. At one end, chamber 46 provides an outlet 46*a* to the exterior of utility knife 10.

So that extra blades 20 may be readily available, utility knife 10 may include a blade storage compartment 50 which permits the convenient storage of spare blades within handle 12. Storage compartment 50 consists of a recessed cavity 52 which is adequately sized to receive a number of spare blades 20. A storage compartment cover 54 which may be hinged at one end to handle 12 or completely removable therefrom securely retains blades 20 within compartment 52. Cover 54 is designed to be readily opened without the need for tools or other instruments so that spare blades 20 may be conveniently accessed.

Figure 9:
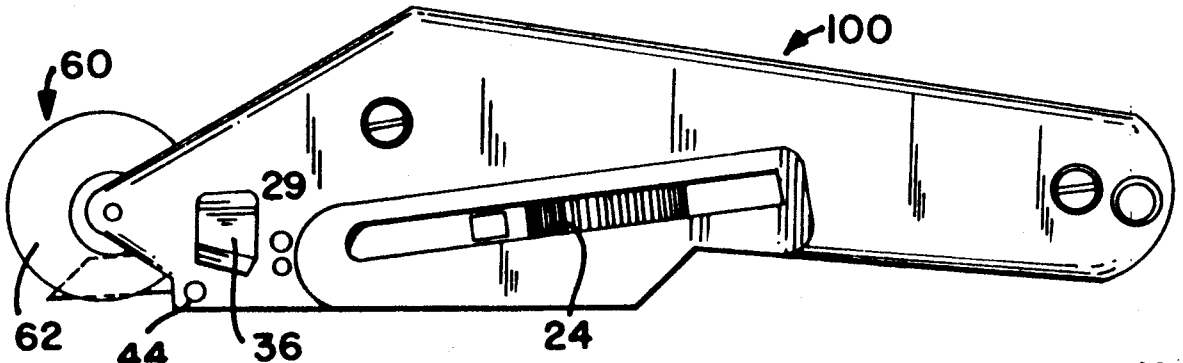
FIG. 9 is a side, elevational view showing the blade detachment mechanism of the present invention in a second utility knife having a guidance mechanism.
Figure 10:
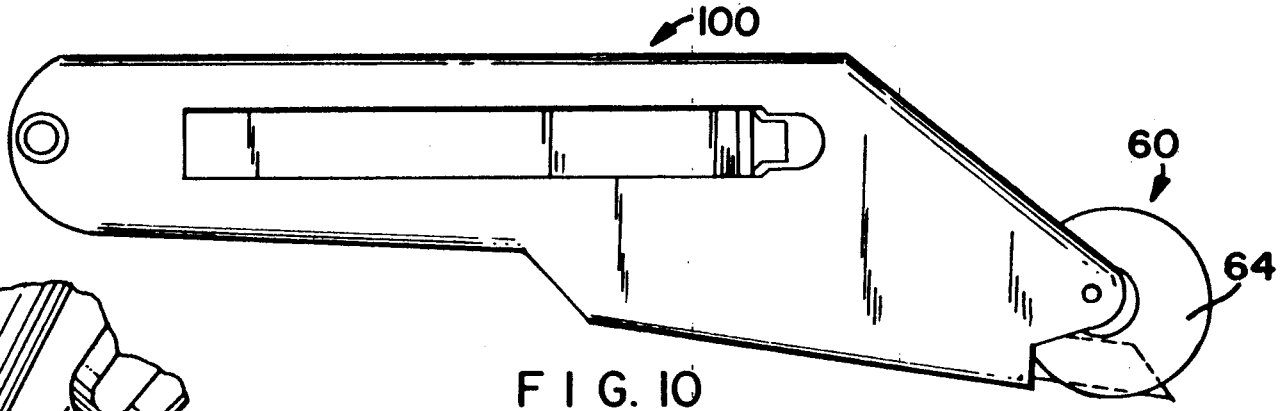
FIG. 10 is an opposite side, elevational view of the utility knife shown in FIG. 9.
Figure 11:
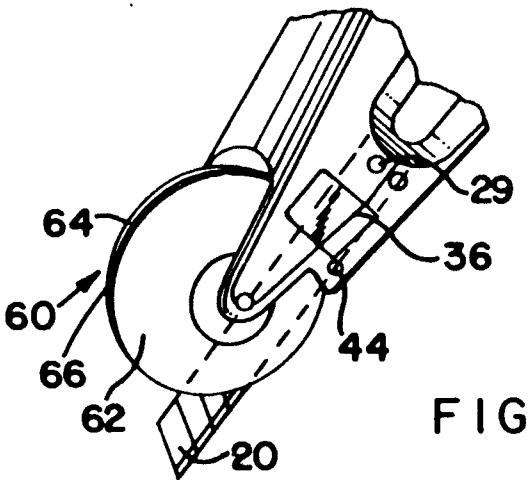
FIG. 11 is a perspective, partial view of the utility knife shown in FIG. 9, showing the blade extended for use therewith.

Optionally, utility knife 10 may include some sort of guidance mechanism which facilitates the cutting of clean, straight or curved lines in, for instance, wallpaper. One such guidance mechanism, described in detail in U.S. patent application Ser. No. 204,104, is indicated generally at 60 on utility knife 100 shown in FIGS. 9-11. Guidance mechanism 60 includes opposed convex rollers 62 and 64 arranged in spaced relation to define medially disposed opening 66. A spacer may be disposed between convex rollers 62 and 64 in order to maintain medial opening 66 at a sufficient width to permit blade 20 to extend therethrough.

Utility knife 10 operates in the same manner whether or not optional guidance mechanism 60 is included therein. Thus, blade 20 is extended for use by sliding adjustment member 24 forward until the tip of blade 20 extends a desired amount beyond blade exit slot 18*b*. By sliding adjustment member 24 in a rearward direction, blade 20 may be retracted within handle 12 when the utility knife 10 is no longer to be used.

Figure 6:
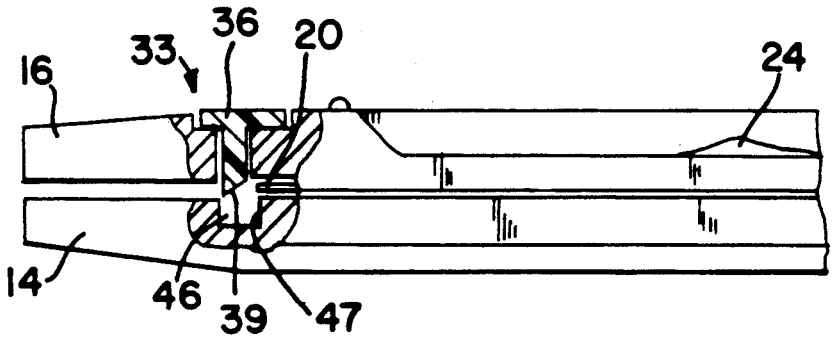
FIG. 6 is a bottom, plan, partial view of the utility knife shown in FIG. 1, partially broken away to reveal the blade in the retracted position and the plunger in the rest position.
Figure 8:
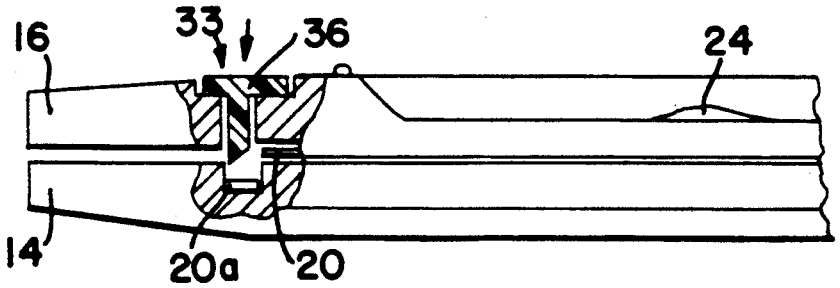
FIG. 8 is a bottom, plan, partial view of the utility knife shown in FIG. 1, partially broken away to reveal the plunger in the activated position and the end blade segment detached from the remainder of the blade.

As the tip of blade 20 wears or becomes damaged, blade detachment mechanism 33 may be actuated as shown in FIGS. 6-8 to detach blade segment 20*a* from the remainder of blade 20, thereby providing blade 20 with a sharp, fresh tip. In order to position blade segment 20*a* for detachment, blade 20 is advanced in the direction of the arrow in FIG. 7 until the forward edge 21 of blade segment 20*a* is visible through alignment aperture 44. Obviously, blade 20 may also be retracted from an extended position until proper alignment is achieved. This alignment procedure positions the entirety of blade segment 20*a* alongside elongated chamber 46. Thus, the segmentation line 22 between blade segments 20*a* and 20*b* extends beyond edge 47 of elongated chamber 46, while substantially the entirety of blade segment 20b precedes edge 47 and, hence, is supported by channel 18 and/or spring member 30.

Positioning blade segment 20a as indicated will cause plunger 36 to slide outwardly of sidewall portion 16 so that blade segment 20a will lie between chamber 46 and the free end of elongated boss 38, as is clearly shown in FIG. 7. Preferably, the free end of elongated boss 38 has a curved or tapered edge 39, blade 20 engaging curved or tapered edge 39 as it is advanced to force plunger 36 outwardly. Pressing firmly on button member 40 as indicated by the arrow in FIG. 8 causes elongated boss 38 to apply a transverse force to blade segment 20a. Upon the application of sufficient force, blade segment 20a will become detached from the remainder of blade 20 along segmentation line 22. Although the energy imparted to blade segment 20a as it becomes detached from blade 20 would typically cause blade segment 20a to travel a significant distance with the risk of injury, elongated chamber 46 restrains such travel. Thus, as blade segment 20a becomes detached from blade 20 it impacts elongated chamber 46 and is thereby retained within the interior of utility knife 10. By merely rotating utility knife so that the outlet 46a of elongated chamber 46 faces downward, the detached blade segment 20a may be expelled from the knife.

It should be noted that should it be desirable to detach more than one blade segment due to wear or damage, the aforementioned procedure may be repeated any number of times in succession as desired. Optionally, utility knife 10 may be designed so that the width of elongated chamber 46 is sufficient to accommodate two or more blade segments simultaneously. In such a design, one, two or more blade segments may be advanced beyond edge 47 as described above and subsequently detached from the remainder of blade 20 simultaneously by exerting a force through plunger 36 on that blade segment closest to, yet beyond edge 47.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised without departing from the spirit and scope of the present invention as defined by the appended claims.

We claim:

1. A mechanism for detaching blade segments along segmentation lines from a segmented knife blade contained within a housing comprising, means in said housing for supporting one longitudinal face of said knife blade, said support means having an edge disposed for substantial alignment with said segmentation lines of said knife blade, means for adjusting said knife blade so that at least one blade segment extends adjacent an unsupported region beyond said edge of said support means, and plunger means slidably disposed in said housing opposite said unsupported region to impart a lateral force upon said at least one extended blade segment to detach said at least one extended blade segment from said knife blade.

2. A mechanism as claimed in claim 1 further comprising alignment means for positioning said at least one extended blade segment between said unsupported region and said plunger means.

3. A mechanism as claimed in claim 2 wherein said alignment means comprises an aperture in said housing for visibly positioning said at least one extended blade segment.

4. A mechanism as claimed in claim 3 further comprising means in said housing for retaining said at least one blade segment as said at least one blade segment is detached from said knife blade.

5. A mechanism as claimed in claim 4 wherein said retaining means comprises chamber means disposed opposite said plunger means, said at least one blade segment extending between said plunger means and said chamber means.

6. A mechanism as claimed in claim 5 further comprising means for removing said at least one blade segment from said chamber after said at least one blade segment is detached from said knife blade.

7. A mechanism as claimed in claim 6 wherein said removal means comprises an outlet connecting said retaining means to the exterior of said housing.

8. A mechanism as claimed in claim 1 further comprising means in said housing for retaining said at least one blade segment as said at least one blade segment is detached from said knife blade.

9. A mechanism as claimed in claim 8 wherein said retaining means comprises chamber means disposed opposite said plunger means, said at least one blade segment extending between said plunger means and said chamber means.

10. A mechanism as claimed in claim 9 further comprising means for removing said at least one blade segment from said chamber after said at least one blade segment is detached from said knife blade.

11. A mechanism as claimed in claim 10 wherein said removal means comprises an outlet connecting said retaining means to the exterior of said housing.

12. A cutting implement comprising, a housing, an elongated knife blade disposed in said housing, said knife blade including a plurality of blade segments joined along segmentation lines, and means, interior of said housing for detaching said plurality of blade segments interior of said housing.

13. A cutting implement as claimed in claim 12 further comprising means in said housing for supporting one longitudinal face of said knife blade, said support means having an edge disposed for substantial alignment with said segmentation lines of said knife blade, and means for adjusting said knife blade so that at least one blade segment extends adjacent an unsupported region beyond said edge of said support means.

14. A cutting implement as claimed in claim 13 wherein said means for detaching said plurality of blade segments comprises plunger means slidably disposed in said housing opposite said unsupported region to impart a lateral force upon said at least one extended blade segment to detach said at least one extended blade segment from said knife blade.

15. A cutting implement as claimed in claim 14 further comprising alignment means for positioning said at least one extended blade segment between said unsupported region and said plunger means.

16. A cutting implement as claimed in claim 15 wherein said alignment means comprises an outlet in said housing for visibly positioning said at least one extended blade segment.

17. A cutting implement as claimed in claim 16 further comprising means in said housing for retaining said at least one blade segment as said at least one blade segment is detached from said knife blade.

18. A cutting implement as claimed in claim 17 wherein said retaining means comprises chamber means disposed opposite said plunger means, said at least one blade segment extending between said plunger means and said chamber means.

19. A cutting implement as claimed in claim 18 further comprising means for removing said at least one blade segment from said housing after said at least one blade segment is detached from said knife blade.

20. A cutting implement as claimed in claim 19 wherein said removal means comprises an outlet connecting said retaining means to the exterior of said housing.

21. A cutting implement comprising, an elongated handle having a front end, a back end, a top edge and a bottom edge, said handle including a first sidewall secured to a second sidewall, at least one of said first and second sidewalls having a lengthwise internal passageway and at least one of said first and second sidewalls having a lengthwise external opening, said opening being at least partially coextensive with said passageway, an elongated knife blade including a plurality of blade segments joined along segmentation lines, said knife blade being slidably mounted between said first and second sidewalls and extendable from said front end of said handle, means in said handle for supporting one longitudinal face of said knife blade, said support means having an edge disposed for substantial alignment with said segmentation lines of said knife blade, means for adjusting said knife blade so that at least one blade segment extends adjacent an unsupported region beyond said edge of said support means, and plunger means slidably disposed in said handle opposite said unsupported region to impart a lateral force upon said at least one extended blade segment to detach said at least one extended blade segment from said knife blade.

22. A cutting implement as claimed in claim 21 further comprising, a protruding member slidably mountable within said passageway and removably fixed to said knife blade, biasing means positioned against said knife blade for holding said knife blade against said protruding member, and releasing means for moving said knife blade laterally against said biasing means, away from said protruding member, to release said knife blade from said protruding member.

23. A cutting implement as claimed in claim 22 wherein said protruding member is affixed to said knife blade adjustment means.

24. A cutting implement as claimed in claim 21 further comprising a blade storage compartment for the storage of spare knife blades.

25. A method of detaching blade segments along segmentation lines from a segmented knife blade comprising the steps of supporting one longitudinal face of said knife blade against a support member in a housing, said support member having an edge disposed for substantial alignment with said segmentation lines of said knife blade, adjusting said knife blade so that at least one blade segment extends between an unsupported region beyond said edge of said support member and a transversely mounted plunger, and actuating said plunger to impart a lateral force upon said at least one extended blade segment to detach said at least one extended blade segment from said knife blade.

26. A method as claimed in claim 25 further comprising the step of retaining said at least one blade segment in said housing as said at least one blade segment is detached from said knife blade.

27. A method as claimed in claim 26 further comprising the step of removing said at least one blade segment from said housing after said at least one blade segment is detached from said knife blade.

* * * * *